US010294770B2

(12) United States Patent
Anghelescu et al.

(10) Patent No.: US 10,294,770 B2
(45) Date of Patent: May 21, 2019

(54) AUTOMATED WORKFLOW CAPTURE FOR ANALYSIS AND ERROR REPORTING IN A DRILLING APPLICATION

(71) Applicant: Landmark Graphics Corporation, Houston, TX (US)

(72) Inventors: Florin M. Anghelescu, Calgary (CA); David Crawshay, Katy, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 219 days.

(21) Appl. No.: 14/913,300

(22) PCT Filed: Oct. 6, 2014

(86) PCT No.: PCT/US2014/059347
§ 371 (c)(1),
(2) Date: Feb. 19, 2016

(87) PCT Pub. No.: WO2015/054155
PCT Pub. Date: Apr. 16, 2015

(65) Prior Publication Data

US 2016/0201446 A1 Jul. 14, 2016

Related U.S. Application Data

(60) Provisional application No. 61/889,872, filed on Oct. 11, 2013.

(51) Int. Cl.

| | |
|---|---|
| ***E21B 47/00*** | (2012.01) |
| ***E21B 41/00*** | (2006.01) |
| ***E21B 44/00*** | (2006.01) |

(52) U.S. Cl.
CPC ..... *E21B 47/00* (2013.01); *E21B 41/0092* (2013.01); *E21B 44/00* (2013.01)

(58) Field of Classification Search
None
See application file for complete search history.

(56) References Cited

U.S. PATENT DOCUMENTS 6,073,109 A * 6/2000 Flores ..... G06Q 10/10 705/7.13
9,147,047 B1 * 9/2015 Grun ..... G06F 21/00
(Continued)

FOREIGN PATENT DOCUMENTS

WO WO-2012144991 A1 10/2012

OTHER PUBLICATIONS

Australian Government IP Australia, Application No. 2014332221, Examination Report No. 3, dated Sep. 18, 2017, 4 pages, Australia.
(Continued)

*Primary Examiner* — Khaja Ahmad

(57) ABSTRACT

Systems and methods for automated workflow capture in a drilling application are provided. The interactions between a user and the drilling application are automatically tracked via a graphical user interface (GUI) of the drilling application executable at a computing device. The tracked interactions are based in part on input received from the user via the GUI with respect to a user-initiated operation related to an activity at a well site. Data for the workflow is captured based on the tracked interactions. The captured workflow data is stored in a memory of the computing device.

20 Claims, 5 Drawing Sheets

(56) References Cited

U.S. PATENT DOCUMENTS

| | | | | |
|---|---|---|---|---|
| 2002/0186254 | A1* | 12/2002 | Monbaron | G06F 3/0481 715/810 |
| 2008/0162248 | A1* | 7/2008 | Vachon | G06Q 10/06 705/7.13 |
| 2009/0037569 | A1 | 2/2009 | Oloughlin et al. | |
| 2009/0198478 | A1 | 8/2009 | Cuevas et al. | |
| 2010/0070463 | A1* | 3/2010 | Zhao | G06Q 10/06 707/608 |
| 2012/0129503 | A1 | 5/2012 | Lindeman et al. | |
| 2012/0303326 | A1 | 11/2012 | Waid et al. | |
| 2012/0317549 | A1* | 12/2012 | Cunningham | G06F 11/3612 717/128 |
| 2012/0324300 | A1* | 12/2012 | Takemoto | G06F 11/2097 714/712 |
| 2013/0124166 | A1 | 5/2013 | Clemens et al. | |
| 2016/0188789 | A1* | 6/2016 | Kisiel | G06F 19/28 703/11 |

OTHER PUBLICATIONS

Australian Government IP Australia, Patent Examination Report No. 1, dated Oct. 12, 2016, 5 pages, Australia.

International Search Report and Written Opinion, dated Jan. 21, 2015, 13 pages, Korean Intellectual Property Office.

* cited by examiner

AUTOMATED WORKFLOW CAPTURE FOR ANALYSIS AND ERROR REPORTING IN A DRILLING APPLICATION

CROSS-REFERENCE TO RELATED APPLICATIONS

The present application is a U.S. national stage patent application of International Patent Application No. PCT/US2014/059347, filed on Oct. 6, 2014, which claims the benefit of U.S. Provisional Patent Application No. 61/889,872, filed on Oct. 11, 2013, titled "Method to Capture the Oil and Gas Field Workflows to Improve the Software," the benefit of both of which are claimed and the disclosure of both of which are incorporated herein by reference in their entireties.

BACKGROUND

1. Field of the Disclosure

The present disclosure relates generally to applications related to activities performed at a well site in a petroleum field, and more particularly, to applications for managing and reporting data related to the activities at a well site.

2. Discussion of the Related Art

Modern drilling operations may involve hundreds of activities that are performed at the site of a well or drilling rig in a petroleum field. There are various software tools/applications being utilized today that assist in the recovery of hydrocarbons. Examples of such "drilling applications" include, but are not limited to, the OpenWells® and OpenWells® Mobile for Workovers information management and reporting systems available from Landmark Graphics Corporation ("Landmark") of Houston, Tex. Such applications may be used, for example, to manage and track all of the drilling and completion activities at a single well site or across the entire field.

Currently, user feedback regarding the use of a drilling application generally requires an end-user to manually collect/document the information and report the information via email, phone, or using a separate online reporting system. For example, a user of a drilling application may report software bugs using a third-party reporting tool, which requires the user to report a defect in the drilling application by manually documenting the steps that may be used to reproduce the problem.

BRIEF DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
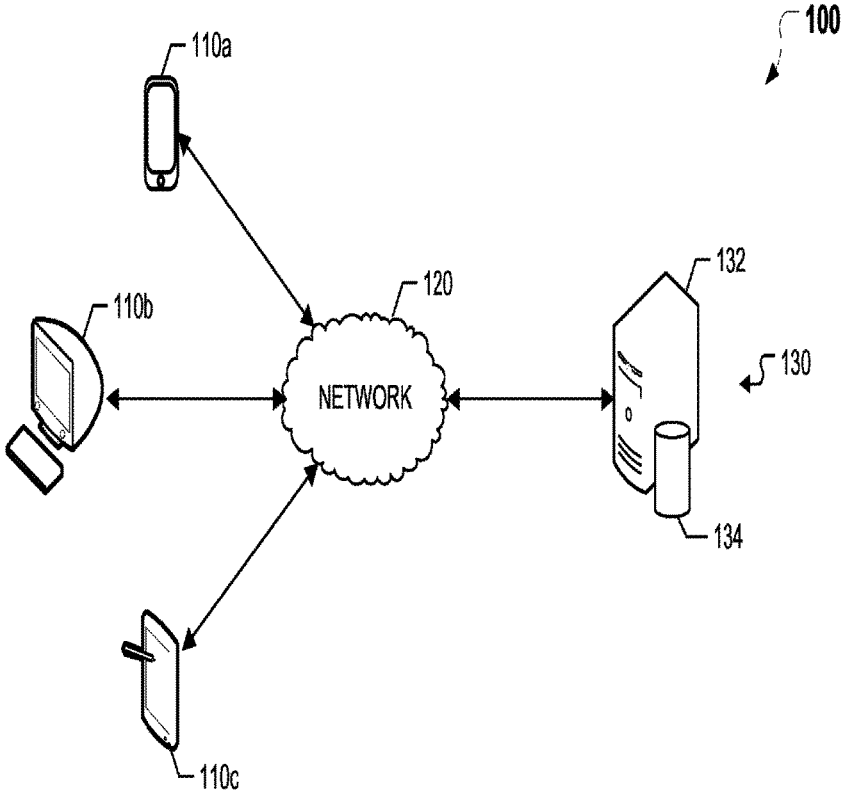
FIG. 1 illustrates an exemplary network environment suitable for practicing an embodiment of the present disclosure.

Embodiments of the present disclosure relate to automated workflow capture in a drilling application. While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility. Further, when a particular feature, structure, or characteristic is described in connection with an embodiment, it is submitted that it is within the knowledge of one skilled in the relevant art to effect such feature, structure, or characteristic in connection with other embodiments whether or not explicitly described.

It would also be apparent to one of skill in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

As used herein, the term "workflow" may refer to a series of actions that are taken by a user and/or a client application executable at a computing device of the user for completing an operation or function provided by the client application. In one example, the client application may be a drilling application, and the operation may be related to an activity performed at a well site for the exploration and/or production of hydrocarbons from a reservoir in a petroleum field. A single operation may include, for example, a sequence of steps that are to be completed by the user as part of an interactive workflow involving a series of interactions between the user and the application. As will be described in further detail below, embodiments of the present disclosure enable such a workflow to be captured automatically, e.g., while the user is interacting with a graphical user interface (GUI) of the application.

The term "drilling application" is used herein to refer to any application program used by personnel in a petroleum field for the exploration, development, and/or production of subsurface hydrocarbon deposits (e.g., oil and natural gas) from one or more reservoirs in the field. Such a drilling application may be used by, for example, a supervisor of a drilling rig or other personnel associated with an oilfield service provider to manage and track various drilling and completion activities at one or more well sites in the field. Examples of such activities include, but are not limited to, cementing, casing, perforations, pipe tally, stimulation, and other activities related to the operation and maintenance of a drilling rig and the wellbore equipment used therein.

As stated above, the collection of information pertaining to workflows in an oil and gas field traditionally has been a manual process. For example, a conventional information reporting system may require a user to document individual activities on a daily basis and report the documented information via email or an online interface of the reporting system. In contrast with such conventional systems, the disclosed embodiments provide systems and techniques for automatically monitoring or tracking a workflow of a user within a drilling application in relation to an operation initiated by the user via a graphical user interface (GUI) of the drilling application.

In one example, a rig supervisor may use a drilling application executable at a tablet or other type of mobile device to collect data and generate reports regarding an activity on a drilling rig. Even if the user is able to generate the desired report, the user may have had a very difficult time in completing the task. By using the disclosed embodiments, the monitoring/tracking mechanism can automatically capture or record the user's interactions with the drilling application as part of a workflow for the particular operation (e.g., report generation) initiated by the user within the application. This may include, for example, recording, among other things, all of the user's interactions with respect to one or more user control elements of the GUI of the drilling application while the operation is performed.

As will be described in further detail below, such a monitoring/tracking mechanism may be used to capture workflow data related to the actions performed by the user via the GUI of the drilling application as well as those performed by the drilling application. Such workflow data may be analyzed to improve the usability and quality of the drilling application. For example, the recorded user-interactions and captured data may be viewed (or "replayed") and analyzed by support personnel for suggesting possible workarounds for application execution errors or other software issues that may be encountered during the workflow. A similar workflow analysis also may be performed by an application developer for determining potential modifications that may be made to the application in order to improve the workflow and the user experience, e.g., by providing the user with a more intuitive interface. In this way, the automated workflow capture techniques disclosed herein may provide an automated user feedback and error reporting mechanism for obtaining useful information related to the workflows in a drilling application, which can be used to implement new application features and/or support existing ones.

The disclosed embodiments and advantages thereof are best understood by referring to FIGS. 1-5 of the drawings, with like reference numerals being used for like and corresponding parts of the various drawings. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

FIG. 1 illustrates an example of a network environment 100 suitable for practicing an implementation of the subject technology. As shown in FIG. 1, network environment 100 includes client devices 110.*a*, 110*b*, and 110*c* ("client devices 110*a-c*") and a computing system 130. Computing system 130 may include, for example, one or more computing devices 132 (e.g., one or more servers) and one or more computer-readable storage devices 134 (e.g., one or more databases). Client devices 110*a-c* may communicate with computing system 130 via a network 120.

Each of client devices 110*a-c* can be any type of any type of computing device having at least one processor and a memory in the form of a computer-readable storage medium for storing data and instructions that can be read and executed by the processor. Such a computing device may also include an input interface for receiving user input or commands via a user input device (e.g., a mouse, QWERTY or T9 keyboard, touch-screen, or microphone). The computing device may also include an output interface for outputting or presenting information via a display coupled to or integrated with the device. In some implementations, the input and output interface may be combined into a single input/output (I/O) interface. Examples of such a computing device include, but are not limited to, a desktop computer, a laptop computer, a smartphone, a tablet, a personal digital assistant (PDA), a network appliance, a media player, a navigation device, an email device, or a combination of any these data processing devices or other data processing devices.

Similarly, computing device 132 can be implemented using any type of computing device capable of sending and receiving data to and from any of client devices 110*a-c* via network 120. In an embodiment, computing device 132 may be a type of server. Examples of such a server may include, but are not limited to, a web server, an application server, a proxy server, and a network server. In some implementations, computing device 132 may represent a group of computing devices in a server farm.

Thus, network environment 100 may represent, for example, a distributed client/server system in which computing device 132 is communicatively coupled to each of client devices 110*a-c* via network 120. Network 120 in this example may be any type of network or combination of networks for carrying data communications. Such a network may include, for example and without limitation, a local area network, a medium area network, and/or a wide area network, such as the Internet. In some implementations, client devices 110*a-c* may communicate with computing device 132 via a private network (e.g., an "intranet") associated with a particular company or organization. Computing device 132 also may be communicatively coupled to storage device 134, e.g., via the private network. Storage device 134 may be one or more data stores or databases used to store any type of data accessible by computing device 132. Such data may include, for example, workflow data captured at each of client devices 110*a-c* based on interactions between a user and a client application executable at each device, as will be described in further detail below.

In the example shown in FIG. 1, client devices 110*a-c* represent various types of computing devices in which the disclosed automated workflow capture techniques may be implemented. Client device 110*a* may be, for example, a smartphone. Client device 110*b* may be, for example, a desktop computer or workstation. Client device 110*c* may be, for example, a tablet or other type of handheld computer. The users of client devices 110*a-c* may be associated with, for example, an oilfield services company responsible for managing hydrocarbon exploration and production operations in a petroleum field. For example, client devices 110*a-c* may be different computing devices used by company personnel to collect data and generate reports related to various activities conducted at a well site in the field.

In an embodiment, a client application executable at each of client devices 10*a-c* may enable a user (e.g., a rig supervisor) to initiate an operation related to a particular activity conducted at the well site. For example, the user may initiate the operation by selecting a corresponding option from a menu displayed within a GUI of the client application, as will be described in further detail below. As described above, the client application may be a drilling application used to perform one or more operations related to one or more activities conducted at a well site, e.g., on a drilling rig. Such an operation may be, for example and without limitation, a data collection and reporting operation related to a particular activity conducted at the well site. The collected data or report generated therefrom may be transmitted to computing device 132 via network 120. Computing device 132 may store the received well site data or report within storage device 134, e.g., as part of a centralized repository for managing such information.

Also, as will be described in further detail below, the drilling application executable at each of client devices 110*a-c* may provide an automated workflow capture functionality for automatically monitoring or tracking the interactions of the user with the application (e.g., via the GUI thereof). Data for a workflow related to the user-initiated operation may be captured at each device in real-time based on the monitoring/tracking. For example, such a monitoring/tracking mechanism can log the workflow in a log file or other data file generated based on the monitored/tracked user interactions. The workflow log may include, for example, a record of all of the monitored/tracked interactions of the user starting from when the application was launched at the client device or the operation was initiated by the user via an introductory screen or page initially displayed by the client application upon startup.

In an embodiment, the workflow log file may be automatically uploaded to a support site or service hosted at computing device 132 via network 120. For example, the drilling application executable at each of devices 110*a-c* may be configured to transmit the log file to a specified Internet Protocol (IP) address for enabling a member of a technical support group to review and analyze the workflow based on the information in the log file. Alternatively, the log file may be sent manually by the user via email. In an embodiment, the log file or captured data may be encrypted or encoded in a secure data format that is accessible to only authorized personnel and thereby prevent unauthorized access or disclosure of sensitive information that may be included within the file.

Figure 2:
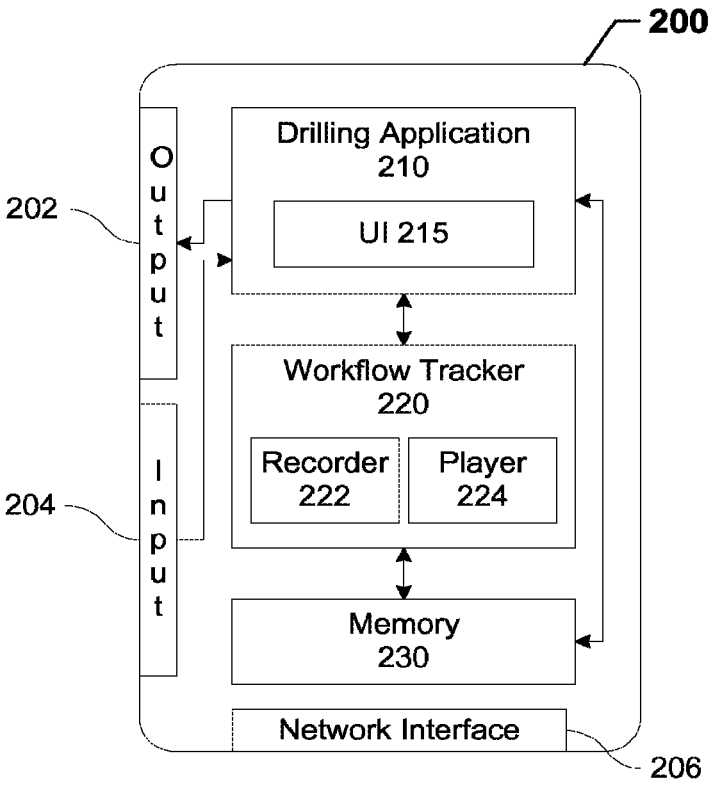
FIG. 2 illustrates an exemplary client device in the network environment of FIG. 1 for enabling automated workflow capture in a drilling application.

FIG. 2 is a block diagram of an exemplary client device 200 for enabling the automated workflow capture functionality disclosed herein. Client device 200 may represent, for example, any of client devices 110*a-c* of FIG. 1, as described above. As shown in FIG. 2, client device 200 includes an output interface 202, an input interface 204, a network interface 206, a drilling application 210, a workflow tracker 220, and a memory 230. While not shown in FIG. 2, it should be appreciated that client device 200 may include additional components for implementing the automated workflow capture functionality described herein and that these other components are not shown in FIG. 2 for ease of explanation and discussion.

In an embodiment, a user may initiate or launch drilling application 210 via an operating system interface executable at client device 200. The user may interact with drilling application 210 as it executes at client device 200 via a GUI 215. GUI 215 may be displayed or presented on a display of client device 200 via output interface 202. GUT 215 may include, for example, an interactive content window for displaying different types of content (e.g., text and/or graphics). GUI 215 may also include various user interface (UI) controls or other elements, which may be displayed along with the content in the interactive content. The user may use an input device (e.g., a touch-screen, mouse, keyboard, or other type of user input device) to interact with any of the displayed UI controls or elements of GUI 215 to initiate an operation related to a particular well site activity or perform different actions related to the initiated operation within drilling application 210.

In an embodiment, the user-initiated operation may involve multiple steps or actions that may need to be performed in order for the operation to be completed. For example, the steps/actions may be performed over a series of interactive pages or screens that may be presented or displayed via GUI 215 (e.g., within the interactive window). Each interactive page/screen in the series may correspond to one or more steps of a workflow for initiating and completing the operation within drilling application 210. Each step of the workflow may in turn correspond to an action performed by the user within one of the pages displayed via GUI 215. In embodiment, the workflow may also include steps/actions performed by drilling application 210. Some of the actions of drilling application 210 may be performed, for example, in response to one or more actions of the user via GUI 215, e.g., with respect to a UI element or control within a page displayed via GUI 215.

Figure 3:
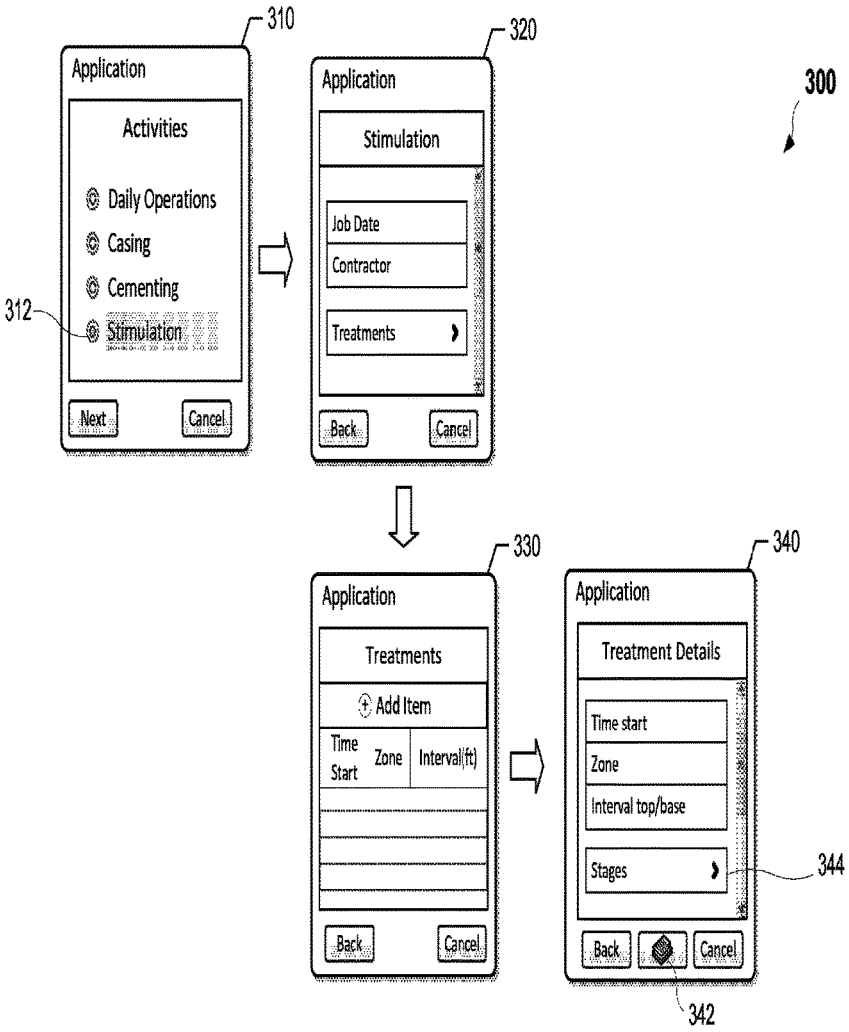
FIG. 3 illustrates an exemplary workflow for a user-initiated operation related to a well site activity, in which the user's interactions with a drilling application are tracked over a series of interactive windows displayed in a GUI of the drilling application.

FIG. 3 illustrates an example of a workflow 300 in which the steps for initiating and completing an operation related to a well site activity are performed over a series of pages displayed via a GUI (e.g., GUI 215) of a drilling application (e.g., drilling application 210), as described above. The operation in this example may be a data collection and report generation operation for a well stimulation activity performed at the well site. The operation may involve, for example, collecting data related to the stimulation activity and generating a report for the activity based on the collected well site data. However, it should be noted that embodiments of the present disclosure are not intended to be limited thereto and that the disclosed embodiments may be applied to any operation related to any of the various activities that may be performed at a well site.

As shown in FIG. 3, workflow 300 includes a series of interactive pages 310, 320, 330, and 340, and the user may perform one or more actions within each page of the series. The initial action performed by the user at the start of workflow 300 may be initiating the operation by appropriately selecting an option 312 corresponding to the stimulation activity from a list or menu of options for different well site activities displayed within interactive page 310. Additional actions performed by the user within successive pages may include, for example, interacting with one or more UI elements or controls that may be provided within a page. Such user interactions may include, for example, the entry of text or other type of data into one or more data fields and selection of one or more user options via a menu or other type of UI control displayed within the page. Other types of UI controls that may be provided within an interactive page may include, for example, navigation control buttons for navigating between different interactive pages (e.g., proceeding to the next page in the series or returning to the preceding page). Also, button controls for canceling or discontinuing the operation prior to completion of the operation may also be provided within each page.

Completion of the operation in this example may correspond to the generation of a report in a final step that may be performed by the user via interactive page 340. The final step may be, for example, the user's selection of a button 342 for invoking the report generating feature via interactive page 340. Thus, the user-initiated operation and workflow 300 may be considered "concluded" or "terminated" when, for example, the user cancels or otherwise discontinues the operation, e.g., by closing or exiting the drilling application at the client device. The user may cancel or discontinue the operation at any stage of the workflow, e.g., after one or more actions/steps are performed but prior to the completion of the final step.

It should be noted that while only four interactive pages are shown in FIG. 3, the disclosed embodiments are not intended to be limited thereto and that workflow 300 may include additional pages depending on the particular operation initiated by the user and/or the actions performed or options selected by the user within each interactive page of the workflow for that operation. For example, one or more additional interactive pages may be displayed via the GUI based on the user's selection of a control button 344 for specifying the stimulation activity in this example is a multi-stage treatment stimulation and adding details for each stage of the treatment.

Referring back to FIG. 2, workflow tracker 220 may automatically monitor or track the interactions between the user and drilling application 210 as part of a workflow (e.g., workflow 300 of FIG. 3) related to the user-initiated operation at client device 200, as described above. The monitored/tracked interactions may be based in part on input received from the user via input interface 204 with respect to one or more UI controls or elements of GUI 215. While workflow tracker 220 is shown separately from drilling application 210 in FIG. 2, workflow tracker 220 may be implemented as a component of drilling application 210 in an embodiment of the present disclosure. For example, the disclosed monitoring/tracking mechanism may be integrated into the processor-executable code or instructions of drilling application 210. Alternatively, workflow tracker 220 may be implemented as a separate application executable at client device 200, which may be configured to monitor or track the interactions between the user and drilling application 210 via an application programming interface (API) of drilling application 210 for enabling the automated tracking features.

In an embodiment, workflow trucker 220 may use a recorder 222 for capturing data for the workflow based on the interactions between the user and drilling application 210. The workflow data may be captured starting from, for example, the point that the operation is initiated by the user (e.g., via interactive page 310 of FIG. 3, as described above) and continuing until the operation is determined to have been completed or otherwise concluded or discontinued. As described above, the user may have abandoned or discontinued the operation by closing the application prior to the completion of the operation e.g., prior to the generation of the report via interactive page 340 of FIG. 3). Alternatively, the operation may have concluded or terminated as a result of an runtime error that occurred in the client application during the workflow and prior to completion of the operation. The captured data may be stored in memory 230. The stored workflow data in memory 230 may be retrieved at a later time and used to perform an analysis of the workflow.

In an embodiment, recorder 222 may be configured to record video data, e.g., capture data that may be used to replay the workflow in the form of a video showing GUI 215 and the user's interactions with GUI 215. In some implementations, such video data may include a series of screenshots captured by recorder 222 on aperiodic basis. For example, the captured screenshots may represent successive image frames of a workflow video captured/recorded by recorder 222 at predetermined frame rate. However, it should be appreciated that any of various techniques may be used to capture or record video data for the workflow.

In an embodiment, workflow tracker 220 may include a player 224 for presenting a visual reproduction of the workflow based on the captured data. In some implementations, drilling application 210 may provide a local playback feature enabling a user of client device 200 to replay the workflow by playing back the recorded video and/or screenshots. In an example, player 224 may invoke a built-in media player of drilling application 210 that allows the user to view the recorded workflow video and/or screenshots within an interactive window of GUI 215. Alternatively, a separate media player may be used for viewing of the recorded video and/or screenshots. The separate media player may be, for example, specially configured to be able to playback the recorded video and/or screenshots (e.g., includes proprietary codecs). However, it should be appreciated that any media player application installed and executable at the user's computing device may be used to playback the recorded video and/or screenshots based on the captured workflow data as described herein.

Additionally or alternatively, the captured and/or stored workflow data may be transmitted via network communication interface 206 over a network (e.g., network 120 of FIG. 1, as described above) to a remote computing device (e.g., computing device 132 of FIG. 1) for enabling workflow analysis by a user of the remote device or providing technical feedback for supporting the application. The remote computing device may include a version of drilling application 210 and player 224 (e.g., running in a "test" mode) with a remote playback feature for replaying the recorded workflow based on the data received from client device 200 via the network. As described above, the user of the remote computing device may be, for example, an application developer and results of the workflow analysis performed by the user may be used to implement new features for the drilling application or improve existing features thereof. In another example, the user of the remote computing device may be an applications engineer or support specialist, who may be able to watch a replay of the first user's workflow and determine exactly what the first user was trying to do in the field.

In an embodiment, the captured workflow data may be sent automatically to the remote computing device by workflow tracker 220 in response to an error event detected during the execution of drilling application 210 at client device 200, as described above. Alternatively, the workflow data may be transmitted in response to a support request initiated by the user of client device 200 (via GUI 215) upon encountering an issue with drilling application 210 during the workflow. For example, if the user encounters an issue or an error occurs when entering data or while updating the well information to a remote server over the network, recorder 222 can log the captured workflow in a log file or other data file. As described above, the log file may be automatically uploaded (e.g., in an encrypted data format) to a particular IP address for enabling an authorized support team member to review the actions/steps of the workflow that lead to the issue/error event, as described above.

Figure 4:
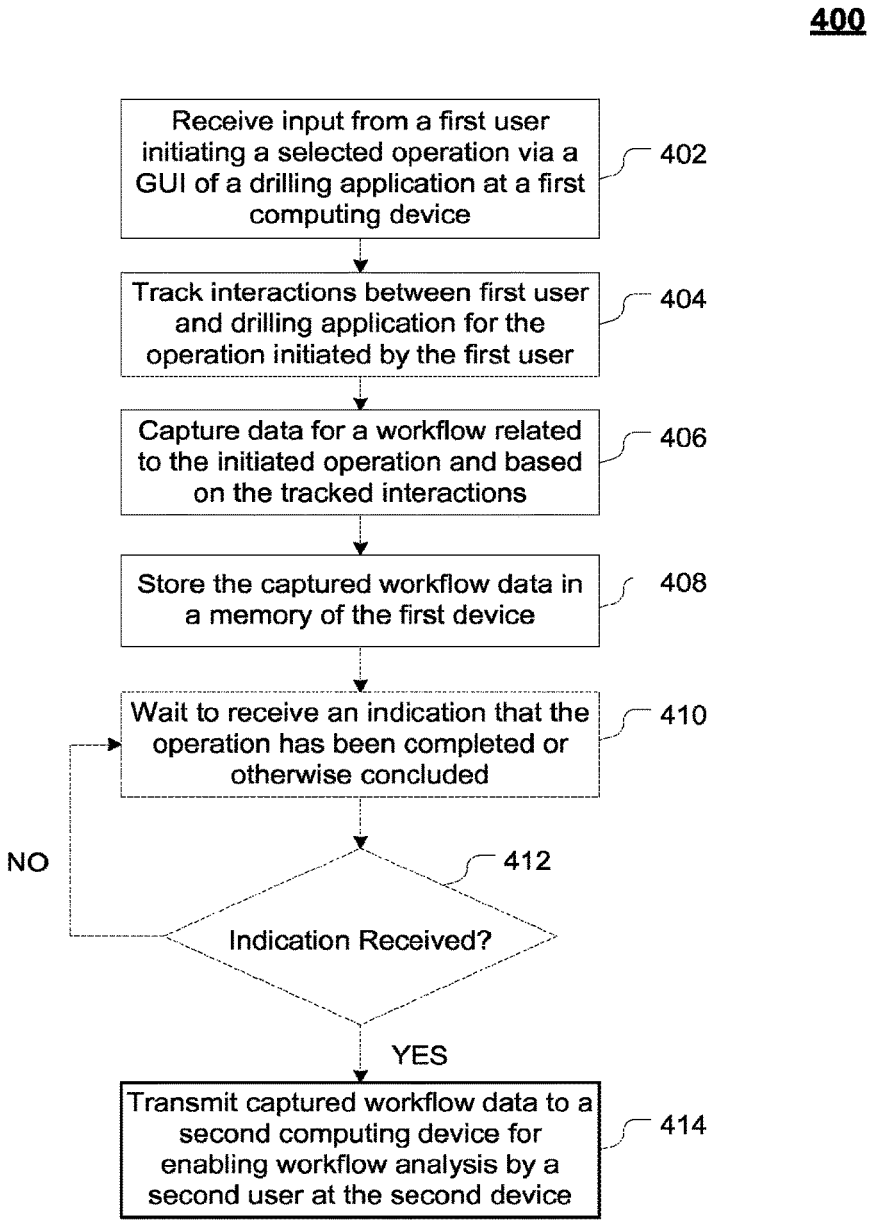
FIG. 4 is a process flowchart of an exemplary method for enabling automated workflow capture in a drilling application.

FIG. 4 is a flowchart of an exemplary method 400 for automatically capturing a workflow in a drilling application. For purposes of discussion, method 400 will be described using network environment 100 and client device 200 of FIGS. 1 and 2, respectively, as described above. However, method 400 is not intended to be limited thereto. As shown in FIG. 4, method 400 includes steps 402, 404, 406, and 408 for capturing and storing data for the workflow at a first computing device (e.g., client device 110*a*, 110*b*, or 110*c* of FIG. 1 or client device 200 of FIG. 2), in accordance with an embodiment. In an embodiment, method 400 also includes step 414 for transmitting the captured workflow data from the first device to a second computing device (e.g., computing device 132 of FIG. 1). As will be described in further detail below, method 400 may optionally include steps 410 and 412 for waiting to receive an indication of an event at the first computing device before transmitting the captured workflow data to the second computing device.

Method 400 begins in step 402, which includes receiving input from a first user initiating a selected operation via a GUI of a drilling application executable at the first computing device (e.g., client device 200 of FIG. 2). As described above, the first user may use an input device (e.g., touchscreen of the first computing device) to interact with the GUI to select the operation to be initiated from a list or menu of options for initiating operations related to different activities conducted at a well site.

In step 404, the interactions between the first user and the drilling application are automatically tracked as the operation initiated by the first user is performed at the first computing device. In some implementations, the tracking may begin as soon as the drilling application is initiated or launched at the computing device, e.g., as part of the startup process or immediately thereafter (e.g., in response to the user's initiation of the operation via the GUI of the drilling application. In an embodiment, the user may have to perform a number of actions for completing the operation over a series of interactive pages or windows displayed within the GUI, as described above. In an embodiment, step 404 may include tracking how the user interacts with each interactive page or window in the series. Examples of the user interactions that may be tracked include, but are not limited to, menu selection, data entry order, user interaction with view controls (e.g., whether the user scrolls up, down, left, or right), and the user interaction with navigation controls (e.g., how the user navigates or moves between one interface window to another).

In addition to the user's actions, the actions or behavior (e.g., resource usage) of the drilling application may be tracked as the operation is performed at the first computing device. Examples of actions of the drilling application that may be tracked include, for example, data storage and retrieval functions performed by the drilling application, e.g., in response to the input received from the user via the GUI. For example, if the user initiates an operation to create a new report via the GUI, actions performed by the drilling application, e.g., checking in a memory of the first computing device for an existing report or data stored for a previously created report, may also be tracked automatically. Examples of additional actions or application behavior that may be tracked include, but are not limited to, the application's response to a user request. Such responses may include, for example and without limitation, application crashes or critical runtime errors causing the application to exit and debugging information to be produced), performance issues that may arise during application execution (e.g., due to excessive resource utilization), and any error conditions that may occur due to incorrect data entry (e.g., if information is entered by the user in an incorrect format, such as the wrong date format, wrong measurement units, or wrong code due to caps lock being turned on).

In step 406, data for a workflow related to the initiated operation is captured based on the tracked interactions. As described above, the steps of the workflow may correspond to the actions performed by the first user or the drilling application as the operation is performed at the first computing device. In step 408, the captured workflow data may be stored in a memory of the first computing device. The memory may be a local storage device or computer-readable storage medium coupled to or integrated with the first computing device. Alternatively, the memory may be a remote data store or database (e.g., database 134 of FIG. 1, as described above) accessible to the first computing device via a network (e.g., network 120 of FIG. 1, as described above).

In an embodiment, method 400 may proceed to step 414, in which the workflow data is transmitted from the first computing device to the aforementioned second computing device via the network. The transmission of the workflow data to the second device may enable the workflow from the first device to be analyzed at the second device by a second user (e.g., an application developer or technical support personnel). The workflow data may be transmitted, for example, in real-time or on a periodic basis while the operation is being performed at the first computing device and as the data is captured in step 406 and/or stored in step 408. Alternatively, the workflow data may be stored at the first computing device and transmitted to the second computing device upon determining that the operation has been completed or otherwise concluded and is no longer being performed at the first computing device.

In a further embodiment, method 400 may also include steps 410 and 412, as noted above. Thus, rather than proceeding directly to step 414 after step 408, method 400 may proceed to step 410, which includes waiting to receive an indication that the operation has been completed or otherwise concluded. In an embodiment, the indication may be in the form of an event indicating that an error has occurred during execution of the drilling application and while the operation is being performed at the first computing device. In an example, step 410 may include automatically detecting the occurrence of such an error event at the first computing device. In a further example, step 410 may also include detecting the occurrence of other types of events including, for example and without limitation, an event indicating that the operation has been cancelled prior to completion or that the drilling application has stopped executing at the first computing device (e.g., the first user has closed or exited the drilling application). In an embodiment, the indication may be in the form of input from the first user initiating a command to transmit the captured workflow data to the second computing device. Such a command may be provided, for example, as part of a technical support feature of the drilling application. The command may be initiated by the first user via, for example, a GUI of the drilling application upon encountering an issue while the user-initiated operation is being performed.

Figure 5:
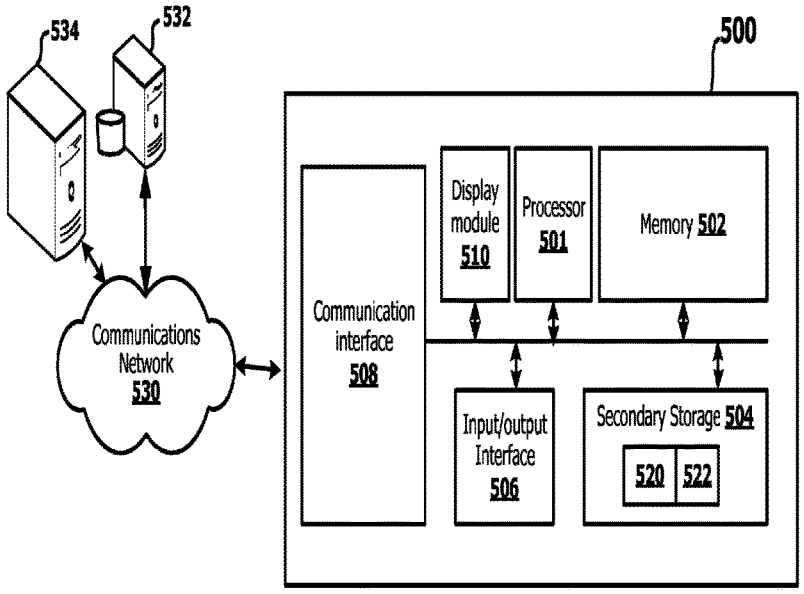
FIG. 5 is a block diagram illustrating an exemplary computer system for implementing the disclosed embodiments.

FIG. 5 is a block diagram of an exemplary computer system 500 for implementing the disclosed embodiments. The system may be any type of computing device such as, but not limited to, a desktop computer, a laptop, tablet, and smartphone. Still, in certain embodiments, the disclosed embodiments may be implemented remotely on server device that is in network communication with comp device that is executing a drilling application.

Generally, in one embodiment, the system 500 includes, among other components, a processor 501, main memory 502, secondary storage unit 504, an input/output interface module 506, and a communication interface module 508. The processor 501 may be any type or any number of single core or multi-core processors capable of executing instructions for performing the features and functions of the disclosed embodiments.

The input/output interface module 506 enables the system 500 to receive user input (e.g., from a keyboard and mouse) and output information to one or more devices such as, but not limited to, printers, external data storage devices, and audio speakers. The system 500 may optionally include a separate display module 510 to enable information to be displayed on an integrated or external display device. For instance, the display module 510 may include instructions or hardware (e.g., a graphics card or chip) for providing enhanced graphics, touchscreen, and/or multi-touch functionalities associated with one or more display devices.

Main memory 502 is volatile memory that stores currently executing instructions/data or instructions/data that are prefetched for execution. The secondary storage unit 504 is non-volatile memory for storing persistent data. The secondary storage unit 504 may be or include any type of data storage component such as a hard drive, a flash drive, or a memory card. In one embodiment, the secondary storage unit 504 stores the computer executable code/instructions and other relevant data for enabling a user to perform the features and functions of the disclosed embodiments.

For example, in accordance with the disclosed embodiments, the secondary storage unit 504 stores the executable code/instructions corresponding to a drilling application 520. In addition, the secondary storage unit 504 may store the executable code/instructions for performing the above-described monitoring/tracking application 522. The executable code/instructions associated with the drilling application 520 and monitoring/tracking application 522 are then loaded from the secondary storage unit 504 to main memory 502 during execution by the processor 501 for performing the disclosed embodiments. As depicted in the diagram, the executable code/instructions for performing the above-described monitoring/tracking application 522 may be a separate application/software module from the drilling application 520. As stated above, in one embodiment, the two applications may interact/communicate via application programming interfaces. Alternatively, in certain embodiments, the executable code/instructions for performing the above-described monitoring/tracking application 522 may be integrated into the executable code/instructions of the drilling application 520.

In certain embodiments, the system 500 includes a network communication interface module 508 for enabling communication with a communications network 530. For example, the network interface module 508 may include a network interface card and/or a wireless transceiver for enabling the system 500 to send and receive data through the communications network 530 and/or directly with other devices. The communications network 530 may be arty type of network including a combination of one or more of the following networks: a wide area network, a local area network, one or more private networks, the Internet, a telephone network such as the public switched telephone network (PSTN), one or more cellular networks, and wireless data networks. The communications network 530 may include a plurality of network nodes (not depicted) such as routers, network access points/gateways, switches, DNS servers, proxy servers, and other network nodes for assisting in routing of data/communications between devices.

In some embodiments, the system 500 may interact with one or more servers 534 or databases 532 (e.g., Landmark's Engineer's Data Model™ database) for performing the automated workflow capture functionality disclosed herein. For instance, the system 500 may query the database 532 to retrieve well data or other information associated with a drilling site.

Accordingly, advantages of the disclosed embodiments include: (1) automatic recording and playback of workflows used in the oil and gas field; (2) eliminate the requirement of a user having to manually write a description of the workflow to explain what he was doing or was attempting to do with the application; (3) the monitoring/tracking mechanism can be integrated in all the drilling applications to improve quality and usability; (4) reduce errors and saves time reporting bugs and usability issues; and (5) provide a visual representation of the workflow using the playback features.

The foregoing methods and systems disclosed herein are particularly useful for enabling automated workflow capture in a drilling application. In one embodiment of the present disclosure, a computer-implemented method for automated workflow capture in a drilling application includes: receiving, via a GUI of a client application executable at a first computing device, input from a first user initiating an operation related to an activity at a well site; automatically tracking interactions between the first user and the client application as the operation initiated by the first user is performed at the first computing device, based in part on the input received from the first user via the GUI of the client application; capturing data for a workflow related to the operation based on the tracking, the captured workflow data including a record of the interactions between the first user and the client application while the operation is performed; and storing the captured workflow data in a memory of the first computing device.

In a further embodiment, the captured workflow data includes a record of the client application's actions as the operation is performed at the first computing device. In yet a further embodiment, the operation initiated by the first user is performed based on input received from the first user via a series of interactive pages displayed within the GUI, each interactive page in the series including a plurality of user control elements. In yet a further embodiment, the captured workflow data includes a record of the first user's interactions with respect to one or more of the plurality of user control elements within one or more of the interactive pages in the series. In yet a further embodiment, the plurality of user control elements include a playback control for viewing a replay of the workflow in the form of a video showing the recorded interactions of the first user with respect to the plurality of user control elements within one or more of the interface pages displayed within the GUI of the client application. In yet a further embodiment, the above-described method further includes transmitting the captured workflow data from the first computing device via a communication network to a second computing device for enabling workflow analysis to be performed by a second user at the second computing device. In yet a further embodiment, the captured workflow data is automatically transmitted to the second computing device in response to receiving an indication that the client application has stopped performing the operation. In yet a further embodiment, the indication is based upon a detection of an error occurring while the operation is being performed. In yet a further embodiment, transmitting the captured workflow data includes generating a workflow log file at the first computing device based on the captured workflow data and transmitting the generated workflow log file from the first computing device via the communication network to the second computing device. The workflow log file enables the second user at the second computing device to view a replay of the workflow including the interactions between the first user and the client application at the first computing device. In yet a further embodiment, the workflow log file is transmitted to the second computing device in an encrypted format accessible only to authorized users including the second user at the second computing device.

In another embodiment of the present disclosure, a system for automated workflow capture in a drilling application includes at least one processor and a memory coupled to the processor including processor readable instructions stored therein, which when executed by the processor configures the processor to perform a plurality of functions, including functions to: receive, via a GUT of a client application executable at a first computing device, input from a first user initiating an operation related to an activity at a well site; automatically track interactions between the first user and the client application as the operation initiated by the first user is performed at the first computing device, based in part on the input received from the first user via the GUI of the client application; capture data for a workflow related to the operation based on the tracking, where the captured workflow data includes a record of the interactions between the first user and the client application while the operation is performed; and store the captured workflow data in a memory of the first computing device.

In yet another embodiment of the present disclosure, a computer readable storage medium has instructions stored therein, which when executed by a processor configures the processor to perform a plurality of functions, including functions to: receive, via a GUI of a client application executable at a first computing device, input from a first user initiating an operation related to an activity at a well site; automatically track interactions between the first user and the client application as the operation initiated by the first user is performed at the first computing device, based in part on the input received from the first user via the GUI of the client application; capture data for a workflow related to the operation based on the tracking, where the captured workflow data includes a record of the interactions between the first user and the client application while the operation is performed; and store the captured workflow data in a memory of the first computing device.

While specific details about the above embodiments have been described, the above hardware and software descriptions are intended merely as example embodiments and are not intended to limit the structure or implementation of the disclosed embodiments. For instance, although many other internal components of the system 500 are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

What is claimed is:

1. A computer implemented method for automated workflow capture in a drilling application, the method comprising:

receiving, via a graphical user interface (GUI) of a client application executable at a first computing device, input from a first user initiating an operation of the client application related to an activity at a well site;

automatically tracking interactions of the first user with one or more user control elements provided within the GUI for enabling the first user to perform actions related to the initiated operation of the client application at the first computing device, based on the input received from the first user via the GUI of the client application;

capturing data for a workflow related to the operation based on the tracked interactions of the first user, the captured workflow data including a record of the actions performed by the first user via the GUI of the client application while the operation is performed by the client application;

storing the captured workflow data in a memory of the first computing device;

receiving an indication of an error event prior to completion of the operation at the first computing device; and responsive to the received indication, transmitting the captured workflow data from the first computing device via a communication network to a second computing device for playback of the workflow to a second user at the second computing device.

2. The method of claim 1, wherein the captured workflow data further includes a record of the client application's actions performed at the first computing device in response to the first user's interactions with the one or more user control elements provided within the GUI.

3. The method of claim 1, wherein the tracked interactions of the first user are based on input received from the first user via a series of interactive pages displayed within the GUI, each interactive page in the series including a plurality of user control elements.

4. The method of claim 3, wherein the captured workflow data includes a record of the first user's interactions with respect to one or more of the plurality of user control elements within each interactive page in the series of interactive pages.

5. The method of claim 4, wherein the plurality of user control elements include a playback control for viewing a replay of the workflow in the form of a video showing the recorded interactions of the first user with respect to the plurality of user control elements within one or more of the interface pages displayed within the GUI of the client application.

6. The method of claim 1, wherein the captured workflow data is transmitted from the first computing device via the communication network to the second computing device for enabling workflow analysis to be performed by the second user at the second computing device.

7. The method of claim 1, wherein receiving the indication comprises detecting that the client application at the first computing device has stopped performing the operation, and the captured workflow data is automatically transmitted to the second computing device in response to the detection.

8. The method of claim 1, wherein the received indication is a support request initiated by the first user via the GUI upon encountering the error event while the operation is being performed at the first computing device.

9. The method of claim 1, wherein transmitting the captured workflow data comprises:

generating a workflow log file at the first computing device based on the captured workflow data; and transmitting the generated workflow log file from the first computing device via the communication network to the second computing device, the workflow log file enabling the second user at the second computing device to view a replay of the workflow including the interactions of the first user with the one or more user control elements provided within the GUI of the client application at the first computing device.

10. The method of claim 9, wherein the workflow log file is transmitted to the second computing device in an encrypted format accessible only to authorized users including the second user at the second computing device.

11. A system for automated workflow capture in a drilling application, the system comprising:

at least one processor; and a memory coupled to the processor including processor readable instructions stored therein, which when executed by the processor configures the processor to perform a plurality of functions, including functions to:

receive, via a graphical user interface (GUI) of a client application executable at a first computing device, input from a first user initiating an operation of the client application related to an activity at a well site;

automatically track interactions of the first user with one or more user control elements provided within the GUI for enabling the first user to perform actions related to the initiated operation of the client application at the first computing device, based on the input received from the first user via the GUI of the client application;

capture data for a workflow related to the operation based on the tracked interactions of the first user, the captured workflow data including a record of the actions performed by the first user via the GUI of the client application while the operation is performed by the client application;

store the captured workflow data in a memory of the first computing device;

receive an indication of an error event prior to completion of the operation at the first computing device; and transmit the captured workflow data from the first computing device via a communication network to a second computing device for playback of the workflow to a second user at the second computing device in response to the received indication.

12. The system of claim 11, wherein the captured workflow data further includes a record of the client application's actions performed at the first computing device in response to the first user's interactions with the one or more user control elements provided within the GUI.

13. The system of claim 11, wherein the tracked interactions of the first user are based on input received from the first user via a series of interactive pages displayed within the GUI, each interactive page in the series including a plurality of user control elements.

14. The system of claim 13, wherein the captured workflow data includes a record of the first user's interactions with respect to one or more of the plurality of user control elements within each interactive page in the series of interactive pages.

15. The system of claim 14, wherein the plurality of user control elements include a playback control for viewing a replay of the workflow in the form of a video showing the recorded interactions of the first user with respect to the plurality of user control elements within one or more of the interface pages displayed within the GUI of the client application.

16. The system of claim 11, wherein the indication is an occurrence of an event indicating that the client application at the first computing device has stopped performing the operation, and the functions performed by the processor include functions to:

responsive to the receipt of the indication, automatically transmit the captured workflow data from the first computing device via the communication network to the second computing device for enabling workflow analysis to be performed by the second user at the second computing device.

17. The system of claim 11, wherein the received indication is a support request initiated by the first user via the GUI upon encountering the error event while the operation is being performed at the first computing device.

18. The system of claim 11, wherein the functions performed by the processor include functions to:

generate a workflow log file at the first computing device based on the captured workflow data; and transmit the generated workflow log file from the first computing device via the communication network to the second computing device, the workflow log file enabling the second user at the second computing device to view a replay of the workflow including the interactions of the first user with the one or more user control elements provided within the GUI of the client application at the first computing device.

19. The system of claim 18, wherein the workflow log file is transmitted to the second computing device in an encrypted format accessible only to authorized users including the second user at the second computing device.

20. A computer readable storage medium having instructions stored therein, which when executed by a processor configures the processor to perform a plurality of functions, including functions to:

receive, via a graphical user interface (GUI) of a client application executable at a first computing device, input from a first user initiating an operation of the client application related to an activity at a well site;

automatically track interactions of the first user with one or more user control elements provided within the GUI for enabling the first user to perform actions related to the initiated operation of the client application at the first computing device, based on the input received from the first user via the GUI of the client application;

capture data for a workflow related to the operation based on the tracked interactions of the first user, the captured workflow data including a record of the actions performed by the first user via the GUI of the client application while the operation is performed by the client application;

store the captured workflow data in a memory of the first computing device;

receive an indication of an error event prior to completion of the operation at the first computing device; and transmit the captured workflow data from the first computing device via a communication network to a second computing device for playback of the workflow to a second user at the second computing device in response to the received indication.

* * * * *